United States Patent [19]

Glucksman

[11] Patent Number: 4,697,066

[45] Date of Patent: Sep. 29, 1987

[54] ELECTRIC HAIR CURLING WAVED WITH IMPROVED HEATING ELEMENT ARRANGEMENT

[76] Inventor: Dov Z. Glucksman, 1578 Beacon St., Brookline, Mass. 02146

[21] Appl. No.: 781,790

[22] Filed: Sep. 30, 1985

[51] Int. Cl.[4] ..... A45D 1/04; H05B 3/10; H01C 7/00

[52] U.S. Cl. ..... 219/225; 132/9; 132/33 R; 132/37 R; 219/222; 219/236; 219/528; 219/534; 219/536; 219/543; 219/549; 338/211; 338/217; 338/308

[58] Field of Search ..... 219/222–226, 219/236–240, 523, 543, 534, 542, 536, 528, 549; 338/217, 218, 243–248, 211, 308; 132/37 A, 37 R, 11 R, 9, 118, 33 R

[56] References Cited

U.S. PATENT DOCUMENTS

| | | | |
|---|---|---|---|
| 1,336,559 | 4/1920 | Gutzwiller | 219/536 |
| 1,358,219 | 11/1920 | Lancaster | 219/523 X |
| 1,477,602 | 12/1923 | Simon | 219/523 |
| 1,555,953 | 10/1925 | Simon | 219/528 |
| 1,674,488 | 6/1928 | Tang | 338/247 X |
| 2,371,696 | 3/1945 | Levitt | 338/218 |
| 2,473,183 | 6/1949 | Watson | 219/543 |
| 2,501,417 | 3/1950 | Smits et al. | 219/534 X |
| 3,129,314 | 4/1964 | Hage et al. | 219/542 X |
| 3,387,248 | 6/1968 | Rees | 219/543 X |
| 4,354,092 | 10/1982 | Manabe et al. | 219/225 |

FOREIGN PATENT DOCUMENTS

| | | | |
|---|---|---|---|
| 2840360 | 4/1980 | Fed. Rep. of Germany | 219/225 |
| 1553082 | 12/1968 | France | 219/225 |
| 119094 | 9/1918 | United Kingdom | 219/225 |

*Primary Examiner*—Anthony Bartis
*Attorney, Agent, or Firm*—John S. Roberts, Jr.

[57] ABSTRACT

An electric heating element for a hair-curling wand having a barrel attached at one end to a handle is inserted into a portion of the barrel and consists of a loop cut out of thin flexible nickel foil having free ends forming terminals for connection to a voltage source, the loop being insulatingly embedded between two thin, flexible sheets of an insulating material. The loop is formed in the shape of two parallel straight stretches and reentrant portions at its both ends, whereby more thermal energy is produced by the end portions than by the central portion, resulting in a sustantially uniform temperature distribution. The heating element is pressed onto the inner wall of the barrel by a resilient, longitudinally slotted tube, which has an initially larger diameter than that of the barrel and is inserted along with the heating element into the barrel by a special compressing tool. Alternatively, the heating element may be a flat resistor strip applied to the flexible sheet on the side remote from the barrel surface.

8 Claims, 13 Drawing Figures

ELECTRIC HAIR CURLING WAVED WITH IMPROVED HEATING ELEMENT ARRANGEMENT

BACKGROUND OF THE INVENTION

The invention relates to an electrically heating hair curling wand, particularly to the electric resistor means adapted to heat the barrel of the wand to a required temperature. It relates more particularly to resistor means adapted to heat the central portion of the barrel to a uniform temperature, and to maintain this temperature during the entire curling operation.

A hair curling wand consists essentially of a handle, a tubular barrel attached to one end of the handle, usually concentric therewith, and an electric heating element inserted into the barrel and energized before and during the use of the curling wand. the appliance is furthermore provided with means of different configuration for firmly gripping the hair strand wound around the barrel; it may consist of a srping-loaded clip adapted to forcefully enbrace a portion of the barrel circumference, of rows of teeth or combs attached to, or integral with, the barrel, or of bristles attached to the barrel thus forming a cylindrical brush.

The appliance serves to curl a strand of hair closely wound around the heated barrel and held in position by one of the hair gripping means; the barrel heat, assisted by various cosmetic liquids applied to the hair, keeps the strand in its curled state after its release from the wand. In this connection it should be noted that the barrel is usually made longer than the width of the hair strand wound around it, and that, for this reason, only the central portion of the barrel is heated to the highest allowable temperature, while the end attached to the handle as well as the far end remain relatively cool. The heating elements used with the conventional curling wands are of two kinds:—1. a so-called rope-heater inserted into the central portion of the barrel and extending over about $\frac{2}{3}$ of the barrel length. This kind suffers from the following drawbacks:—contact between the barrel inside surface and the rope heater is only along a series of points, instead over the entire resistor surface; this results in inadequate heat transfer and, therefore, in slower heat-up time. It also requires a barrel of relatively great wall thickness, in order to equalize the temperature over the entire area. Another drawback of the ropeheater type is that a maximum temperature is reached in the central portion of the barrel and decreasing from there to both ends; and 2. A "positive-temperature-coefficient" element (PTC) which consists of a semi-conductor embedded in a cylindrical body of an inslating material of a diameter corresponding to the inner diameter of the barrel and occupying about 50% of the barrel length. While this heating element presents considerable advantages compared with the rope-heater, particularly in regard to the danger of overheating and in respect of contact along one or more lines between heater surface and barrel interior instead of in several points only, its high cost is a deterrent against its use in low-cost curling irons. And here again, as with the rope-heater, a relatively thick-walled barrel tube becomes necessary in order to obtain uniform distribition of temperature, since due to the nature of the PTC-element a maximum temperature is reached in the central portion of the element—and of the barrel—from where it gradually decreases to both ends of the barrel.

The present invention has therefore, as its main object to provide a heating element adapted to be inserted into the barrel so that intimate contact with the barrel inside is ensured over the entire surface of the heating element, with the result that a thin-walled barrel tube can be utilized.

It is another object to provide a heating element of a resistor material having a high positive thermal coefficient of resistance, so as to dispense with a thermostatic switch and at the same time prevent overheating of the barrel.

And it is a final object of the invention to provide a heating element which will emit a larger amount of thermal energy in its end portions than in its central portion, the energy distribution being so designed that the barrel portion containing the heating element should be heated to substantially uniform temperature.

SUMMARY OF THE INVENTION

The improved heating element of a hair curling wand, according to the invention, consists of an electric resistor in flexible, rolled-up sheet form continuous at least part of the inner surface of the tubular barrel and brought into forced intimate contact with this surface by elastic spring means positioned inside the element and the barrel. The heating element has a front portion proximate the handle of the curling wand and a rear portion proximate the outer end of the barrel, and the electric resistance is distributed to effect a higher heat generation through the end portion proximate the outer end of the barrel, and the electric resistance is distributed to effect a higher heat generation through the end portions than through the central portion, in a manner causing uniform temperature distribution over the entire length of the heating element.

The resistor is provided with terminals for conductive connection to an electric power source and is insulated against contact with conductive portions of the curling wand. In the case of a metal barrel the resistor is separated from the barrel material by a very thin sheet of an electrically insulating and heat resistant material which is, however, not necessary in the case of a barrel of a non-conductive material, such as plastics, where the resistor material may be in direct contact with the barrel interior.

In a preferred embodiment the heating element consists of a strip of a resistor material laid out across the area to be heated in a distribution comprising a greater length of strip accumulated in the end portions than in the central portion of the heating element. The resistor is preferably cut out of a foil of Nickel in the form of a loop with reentrant portions at both ends, and with terminals at the front end of the element. This foil is insulated on the side proximate the barrel surface by a thin polyimide film, while the opposite surface is insulated by a thicker sheet of insulating and heat resisting material.

The means for providing internal pressure onto the heating element urging it towards the barrel wall is preferably in the shape of a longitudinally slotted, elastic tube of an initially larger diameter than that of the barrel, which is adapted to be contracted by a special tool and to be released after its insertion into the previously rolled-up heating element.

The material of the resistor strip is chosen to have a high positive thermal coefficient of resistance, which will result in rapid heating up to the desired temperature and in remaining at this temperature for the entire period of energization, owing to its increased electrical resistance; a preferred material is Nickel or any other pure metal which possesses the required high positive thermal coefficient of resistance.

Another embodiment of a heating element consists of a rectangular thin and flexible sheet of an electrically and thermally insulating amterial one side of which is coated close to its longitudinal edges with one strip each of a highly conductive material such as silver or copper, while the area between the two conductors is coated with a layer of a resistive material in a distribution effecting a lower ohmic resistance in the central portion than in the end portions, resulting in a higher current concentraton in the end portions. The strips of conductive material are connected, in a known manner, to an electric power source.

The side in contact with the elastic pressure means is covered by a sheet of insulating material of a thickness permitting the rolling-up of the heating element for insertion into the barrel.

SHORT DESCRIPTION OF THE DRAWINGS

DESCRIPTION OF PREFERRED EMBODIMENTS OF THE INVENTION

Figure 1:
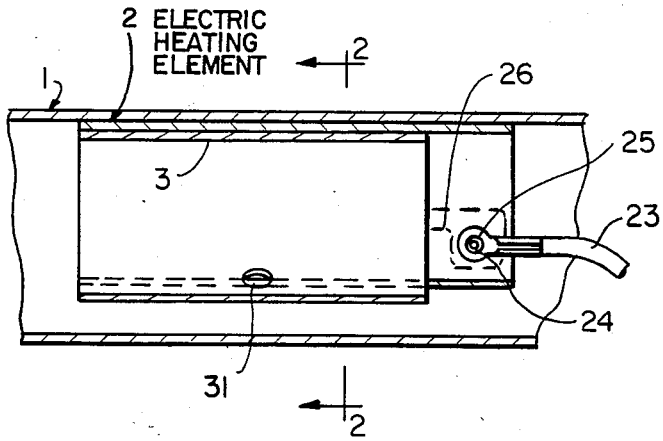
FIG. 1 is a longitudinal section through the portion of a barrel of curling wand, through the heating element and the spring means inserted therein.
Figure 2:
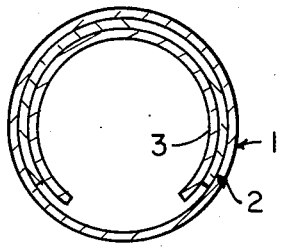
FIG. 2 is a section along lines 2—2 of FIG. 1.
Figure 1A:
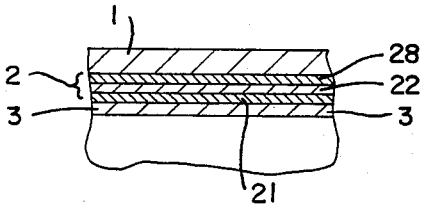
FIG. 1A is a sectional view showing the outer sheet, the inner sheet, and the resistor.
Figure 3:
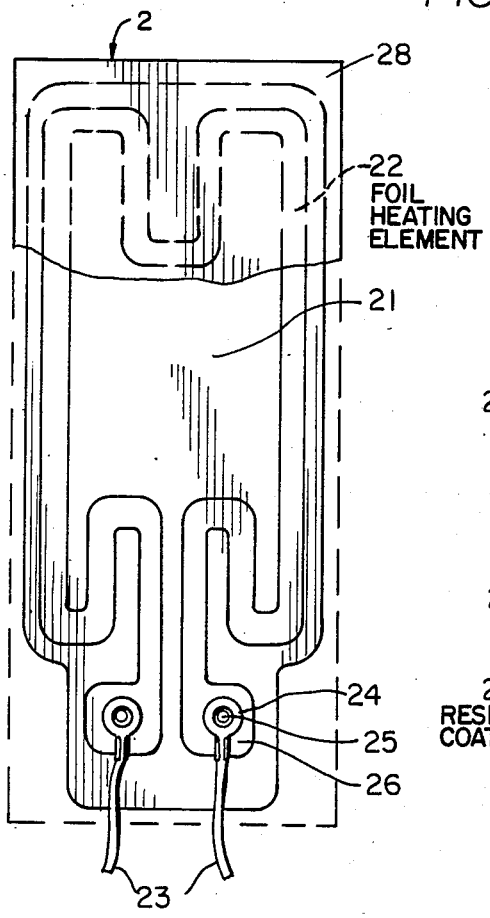
FIG. 3 is a developed elevation of a heating element comprising a looped strip of resistive material.
Figure 4:
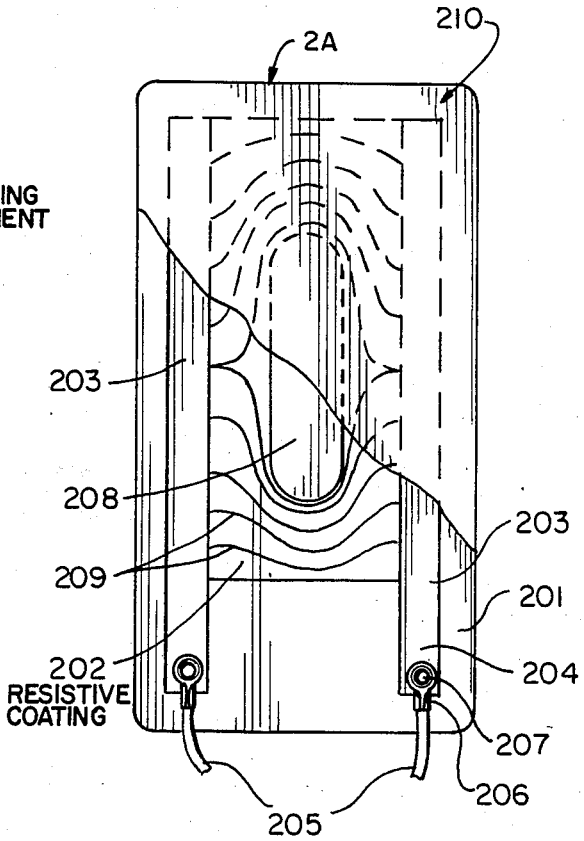
FIG. 4 is a plan view of resistor composed of an insulating sheet coated with conductive and resistive material respectively.

FIGS. 1 and 2 show a section of a hair curling wand according to the present invention consisting of an outer barrel 1 and a sandwiched heater 2 which is forcibly urged against the inner wall of the outer barrel by means of a spring clip 3. The sandwiched heater 2 is either of a design as shown in FIG. 3 or FIG. 4 or of a different design provided it is properly insulated, electrically, in its area of contact with metallic parts and that it is sufficiently elastic to closely adhere to the inner surface of the outer barrel. It should be noted that only the resistive portion of the heater is compressed between the barrel and the spring clip. The conductive tabs 26 of the heater are free of compression.

The perforation 31 in the spring clip 3 is one of two perforations provided so that the clip can be compressed by using a specially adapted needle-nose pliers, and is placed in a predetermined relationship to the heater and the barrel. In fact, in order to assist in the assembly of the heater, it may be pre-glued to the outer surface of the spring-clip 3 before compressing and inserting it into the barrel.

Figure 12:
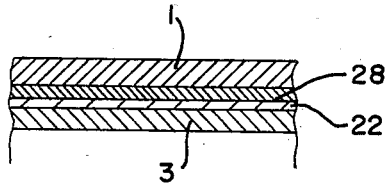
FIG. 12 is a sectional view of an alternative embodiment of FIG. 1A, i.e. comprising a flat resistor strip attached to a flexible sheet sandwiched between a non-conductive barrel and a non-conductive elastic means.

Figure A shows a metallic outer barrel 1 and sandwiched heater 2 comprising, in layers, a thin sheet 28 of insulating material, a resistor 22, and a thicker sheet 21 of insulating material. FIG. 12 shows an alternative configuration wherein barrel 1 is non-metallic and heating element 22 is sandwiched only between a thin sheet 28 of insulating material and elastic means 3 of nonconductive material.

FIG. 3 shows a sandwiched heater 2 consisting of a layer of 0.005 inches Nomex Paper 21, a 0.001 inch Nickel foil heater 22 glued to said Nomex Paper 21 and die-cut in such a fashion that there are six short parallel legs at the bottom of the heater and four short parallel legs at the top of the heater whereas in the center portion of the heater there are only two parallel elgs. The heater would, therefore, generate substantially more heat at both ends than in the center. The heater is terminated with two large integral pads 26. Two wire leads 23 are attached to the tabs by means of ring terminals 24 and eyelets 25. The eyelets are driven throught both the Nickel-foil and the Nomex Paper so that the Nomex Paper which is stronger than the foil would prevent the leads from tearing the foil when pulled. The heater including the ring terminals and a portion of the leads are then covered with a thin layer of 0.001 inch polyimide film 28 which is a good electrical insulator, withstands high temperatures and is a good thermal conductor. The polyimide side of the heater snadwich is placed next to the barrel in the curling wand the Nomex side which is a lesser heat-conductor is placed next to the spring clip, thus assuring that most of the heat is transferred to the barrel. Since the Nomex side of the heater is not electrically insulated in the area where the ring terminals are attached by the eyelets it is important that the spring clip not be extended into that area so that it would not "short" against the terminals.

FIG. 4 described an alternative sandwiched heater 2A consisting of a lower layer 201 which is heat resistant, flexible and electrically insulating (e.g., Nomex Paper, impregnated, woven glass fiber cloth, polyimide film or Teflon film). This lower layer 201 is coated, on its upper face, with a resistive layer 202 of a given resistivity, defined in terms of micro ohm per cm (e.g., carbon particles suspended in a polymer resin).

Along the sides of the resistive coating two parallel strips 203 of a conductive coating (e.g., silver or Nickel particles suspended in a thermoset resin) are coated in conductive relationship to the resistive coating. The conductive strips extend beyond the zone of the resistive—coating forming two extensions 204. Onto each of the two extensions 204 of the conductive coating an insulated wire lead 205 is attached, using a ring-terminal 206 which is firmly and conductively attached to the extensions 204 by means of a brass eyelet 207. The resistive coating 202 exhibits a void area in its center 208. When electric potential is applied to the two conductive strips 204 the resulting electric current-flow will approximate the flow lines 209 and the heat density generated by the current flow would be proportionate to the current flow line density resulting in larger amounts of heat generated towards the ends of the heater. A second layer 210 which is heat resistant, flexible and electrically-insulative covers the entire heater including the ring terminals and eyelets to assure perfect electrical insulation.

Figure 5:
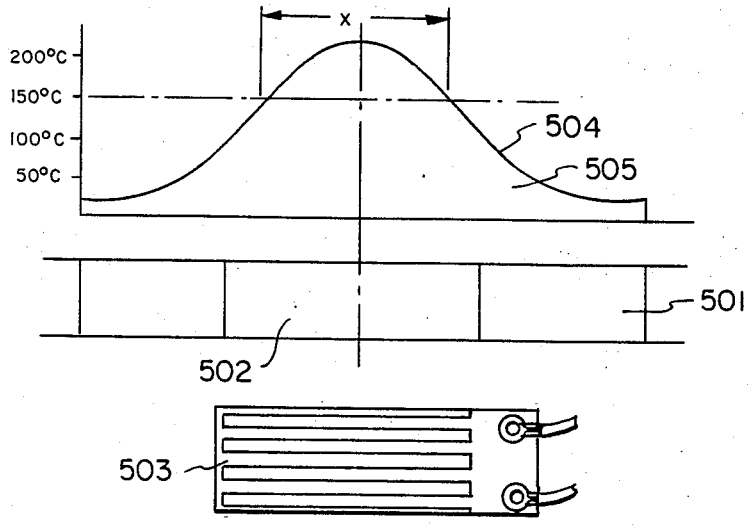
FIG. 5 shows a curling wand provided with a heating element that generates an even amount of heat throughout and a diagram of the temperature distribution along the barrel.
Figure 6:
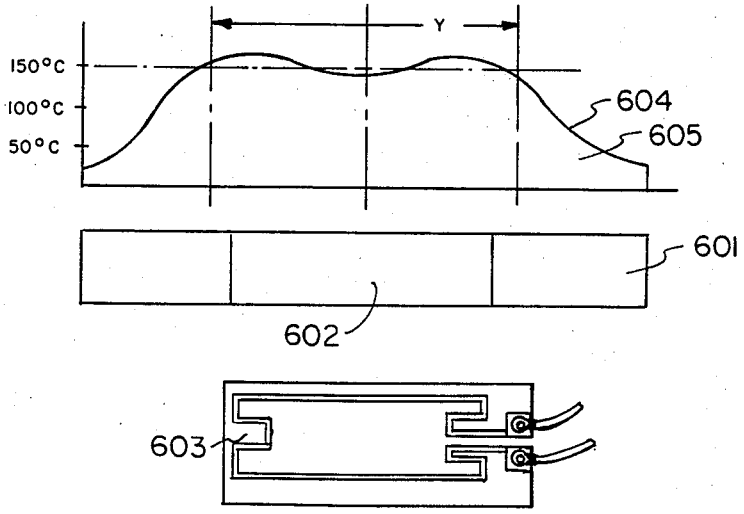
FIG. 6 shows a curling wand provided with a heating element of the invention as illustrated in FIG. 3 and a diagram of the temperature distribution along the barrel.
Figure 7:
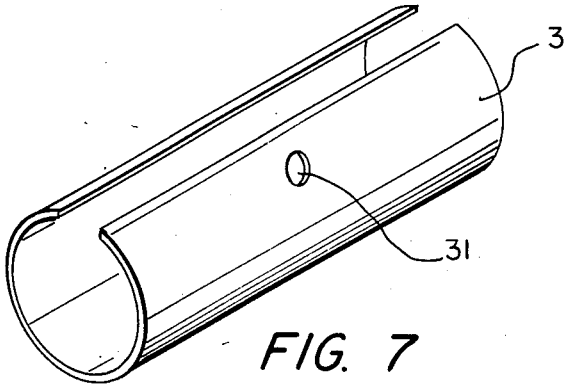
FIGS. 7 and 10 show isometric views of 4 different spring clips serving to urge the heating element towards the barrel surface.
Figure 8:
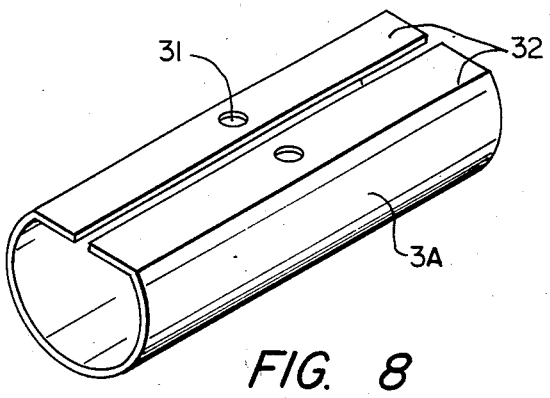
Figure 9:
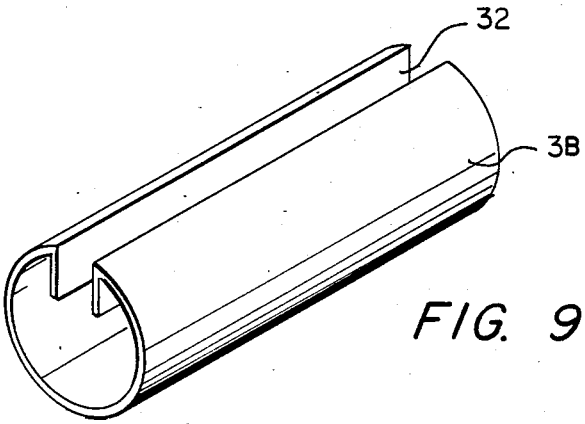
Figure 10:
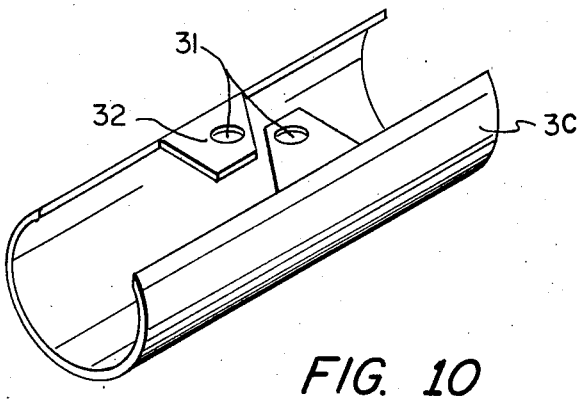

FIGS. 5 and 6 illustrate two curling wands with two different heaters 503 and 603. Heater 503 exhibits even generation of heat along the entire heating area 502. Heater Number 603 is so designed that the heat generation is concentrated at the ends of the heating area 602. The resulting temperature distribution is shown in curves 504 and 604. In curve 504 the portion "x" of the wand 501 which attained temperatures above 150 degrees celsius is quite narrow compared with the portion "y" of wand 601 which attained temperatures above 150 degrees celsius. The respective areas under the curves 505 and 605 (which are proportional to the heat loss) are quite similar, thus by using heater 603 a more efficient use of power is being achieved.

FIGS. 7, 8, 9, and 10 illustrate four different spring-clips which only differ in the means for compressing them prior to assembly into the curler barrel. These examples are only a sampling of a wide variety which could be successfully utilized.

Spring clip 3 (A, B, or C) contains a perforation(s) 31 and are provided with opening proximate to the edges 32 of said slot for engagement with parts of a tool serving to insert the spring clip into the barrel (1, shown in FIGS. 1 and 2).

Figure 11:
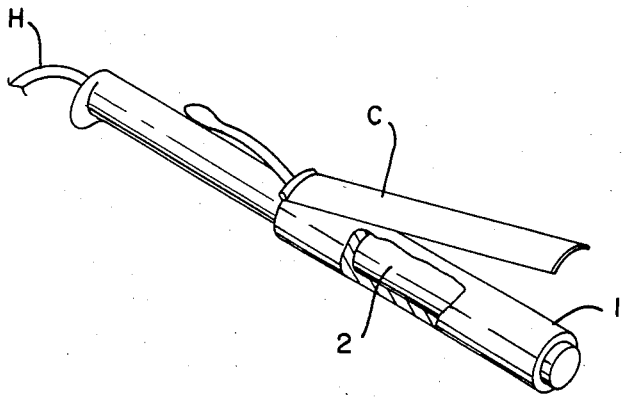
FIG. 11 shows a curling wand having a tubular barrel, a handle, and hair holding means.

FIG. 11 illustrates a hair curling wand comprising a handle H, a tubular barrel 1, a sandwiched heater 2, and means C for firmly holding strands of hair wrapped around barrel 1.

It will be understood that the heating element and the spring means illustrated and described in the foregoing represent only sample embodiments of the invention, which may undergo alterations and modifications at the hands of a person skilled in the art, within the scope of the appended claims.

I claim:

1. In a hair curling wand comprising a handle, a tubular barrel having a far end and a near end, and being attached at said near end to said handle, and means for firmly holding strands of hair wrapped around said barrel, the improvement comprising a heating element in the form of a flat flexible sheet of a non-conductive material and a resistor in the form of a flexible conductor layer applied to said sheet in a configuration effecting a higher heat output in opposite end areas and a lower heat output in the central area upon application of an electric potential, said heating element being positioned in rolled-up state in said barrel in contiguous relationship with a portion of its inside surface, with the end portions of higher heat output directed towards the respective two ends of said barrel, terminals on said resistor layer for conductive connection to an electric power source, elastic means in said barrel serving to urge said heating element onto the inside wall of said barrel, in the form of at least one elastic slotted compressible cylinder of an initially larger diameter than said barrel diameter, slotted lengthwise and provided with means for cooperation with a tool for compressing the cylinder during insertion of said cylinder in compressed state into said heating element inside said barrel.

2. In the hair curling wand of claim 1, wherein said barrel comprises a metallic barrel and said heating element consists of a flat resistor strip insulated on both sides by a heat-resistant and electrically insulative material.

3. In the hair curling wand of claim 2, wherein said barrel is metallic and said heating elements comprises a thin sheet of a thermal and electrical insulating material positioned between said resistor and said barrel and a thicker sheet of a thermal and electrical insulating material positioned between said resistor and said elastic urging means.

4. In the hair curling wand of claim 1, wherein said heating element has a first end proximate said handle of said curling wand and a second end proximate the outer end of said barrel, wherein the ohmic resistance in said resistor is distributed in such a manner that an applied electrical potential will cause a higher density of current flow in said two end portions than in the central portion, resulting in uniform temperature distribution along said heating element.

5. In the hair curling wand of claim 1, said barrel being made of a non-metallic and electrically insulative material, and said heating element consisting of a flat resistor strip applied to said flexible sheet on the side remote from said barrel surface, and said elastic means being in the form of a slotted cylinder of a non-conductive material.

6. In the hair curling wand of claim 5, said resistor consisting of a strip of a resistive material in the form of a loop having reentrant portions at both said ends to effect higher heat output at these ends, said loop being provided with said terminals at the end directed towards said near end of said barrel.

7. In the hair curling wand of claim 6, said loop being in substantially rectangular in configuration, comprising two parallel longitudinal stretches and reentrant portions at its both ends.

8. In the hair curling wand of claim 6 wherein said resistor is cut out of a foil of a resistive material.

* * * * *